US011801979B2

(12) United States Patent
Lei

(10) Patent No.: US 11,801,979 B2
(45) Date of Patent: Oct. 31, 2023

(54) CONTAINER WITH SECURITY LOCK

(71) Applicant: Jing Lei, Guangdong (CN)

(72) Inventor: Jing Lei, Guangdong (CN)

( * ) Notice: Subject to any disclaimer, the term of this patent is extended or adjusted under 35 U.S.C. 154(b) by 0 days.

(21) Appl. No.: 17/884,506

(22) Filed: Aug. 9, 2022

(65) Prior Publication Data

US 2023/0119991 A1 Apr. 20, 2023

Related U.S. Application Data

(60) Provisional application No. 63/257,741, filed on Oct. 20, 2021.

(51) Int. Cl.
*B65D 50/04* (2006.01)
*B65D 43/02* (2006.01)

(52) U.S. Cl.
CPC ..... *B65D 50/041* (2013.01); *B65D 43/0225* (2013.01); *B65D 2255/20* (2013.01); *B65D 2543/00537* (2013.01)

(58) Field of Classification Search
CPC ..... B65D 50/041; B65D 43/0225; B65D 2255/20; B65D 2543/00537; B65D 2313/04
See application file for complete search history.

(56) References Cited

U.S. PATENT DOCUMENTS

| | | | | |
|---|---|---|---|---|
| 10,940,982 | B1 | 3/2021 | Lei | |
| 2018/0194518 | A1* | 7/2018 | Li | B65D 23/12 |
| 2019/0144175 | A1* | 5/2019 | Patton | B65D 50/04 215/252 |
| 2020/0148435 | A1* | 5/2020 | Brown | B65D 50/041 |
| 2021/0323736 | A1 | 10/2021 | Lei | |
| 2021/0347537 | A1* | 11/2021 | Sanchez | B65D 50/041 |

* cited by examiner

*Primary Examiner* — Shawn M Braden
(74) *Attorney, Agent, or Firm* — Justin Lampel

(57) ABSTRACT

A container with a security lock is provided. The container may have a lid (or "top") portion and a bottom portion. The lid portion may have an exterior cover, a first disc, a second disc and a third disc. The first disc may have a plurality of indented downward partial trapezoids. The second disc may also have a plurality of nearly identical, upwardly extending partial trapezoids wherein the plurality of indented partial trapezoids of the first disc may be temporarily and selectively located between the plurality of partial trapezoids of the second disc in order to allow the lid to be rotated and the container therein opened. The third disc may be made of a thin material that allows the container to remain substantially airtight.

8 Claims, 5 Drawing Sheets

CONTAINER WITH SECURITY LOCK

REFERENCE TO RELATED APPLICATIONS

This application claims priority to U.S. Provisional Application No. 63/257,741 titled "CONTAINER WITH SECURITY LOCK" which was filed on Oct. 20, 2021, the entire contents of which are incorporated by reference herein.

BACKGROUND OF THE INVENTION

A container with a security lock is provided. The container may have a lid (or "top") portion and a bottom portion. The lid portion may have an exterior cover, a first disc, a second disc and a third disc. The first disc may have a plurality of indented downward partial trapezoids. The second disc may also have a plurality of nearly identical, upwardly extending partial trapezoids wherein the plurality of indented partial trapezoids of the first disc may be temporarily and selectively located between the plurality of partial trapezoids of the second disc in order to allow the lid to be rotated and the container therein opened. The third disc may be made of a thin material that allows the container to remain substantially airtight.

Containers with security locks are known. For example, U.S. Pat. No. 9,481,496 to Cottle discloses a child resistant container for nicotine products. The container comprises latching elements adapted to interlock with cooperating latching elements when said lid is pushed onto a said base to retain said lid to said base. The latching elements are further adapted to disengage from said cooperating latching elements when a simultaneous force is exerted on all releasable latching arrangements by two hands of a user or the like.

Further, U.S. Pat. No. 9,187,220 to Biesecker discloses a cap having a top wall, an outer peripheral edge, a first section, and a second section. A skirt depends from the outer peripheral edge. The skirt includes an attached end, a free end, a plurality of slots, and a plurality of apertures. Each aperture is spaced-apart from the free end of the skirt. The top wall has a first configuration and a second configuration. When the top wall is in the first configuration, the first section is generally planer and the second section is generally arcuate. When the top wall is in the first configuration, the skirt extends generally perpendicularly to the first section to generally engage at least a portion of a container. When the top wall is in the second configuration, the free end of the skirt extends radially outwardly from the attached end thereof to allow the cap to be removed from the container.

Still further, U.S. Pat. No. 8,931,657 to Kientzle discloses a pharmaceutical container having a bottle having a bottom wall and side walls. A ridge proximate to the bottom wall projects from an interior surface of at least one of the side walls, to facilitate nested stacking of a plurality of bottles. One or more of the side walls includes a cover locking receptacle proximate to the top end of the side wall. The pharmaceutical container also includes a cover including a sliding lid contained in a cover housing. The cover housing has a top wall, which includes an opening, and cover side walls. A child-resistant closure mechanism is also provided to limit the movement between the sliding lid and the bottle.

However, these patents fail to describe a container with a security lock which is easy to use. Further, these patents fail to provide for a container with a security lock which allows a user to unlock a child-resistant container in a simple and safe manner.

SUMMARY OF THE INVENTION

A container with a security lock is provided. The container may have a lid (or "top") portion and a bottom portion. The lid portion may have an exterior cover, a first disc, a second disc and a third disc. The first disc may have a plurality of indented downward partial trapezoids. The second disc may also have a plurality of nearly identical, upwardly extending partial trapezoids wherein the plurality of indented partial trapezoids of the first disc may be temporarily and selectively located between the plurality of partial trapezoids of the second disc in order to allow the lid to be rotated and the container therein opened. The third disc may be made of a thin material that allows the container to remain substantially airtight.

An advantage of the present child resistant storage container is that the present child resistant storage container is suitable for seniors which typically have difficulty opening typical child resistant containers.

And another advantage of the present child resistant storage container is that the present container keeps the contents of the container secure and dry in a moisture-resistant manner.

Still another advantage of the present child resistant storage container is that the present container lacks exterior sharp edges and corners which may otherwise injure someone.

For a more complete understanding of the above listed features and advantages of the container with a security lock reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A container with a security lock is provided. The container may have a lid (or "top") portion and a bottom portion. The lid portion may have an exterior cover, a first disc, a second disc and a third disc. The first disc may have a plurality of indented downward partial trapezoids. The second disc may also have a plurality of nearly identical, upwardly extending partial trapezoids wherein the plurality of indented partial trapezoids of the first disc may be temporarily and selectively located between the plurality of partial trapezoids of the second disc in order to allow the lid to be rotated and the container therein opened. The third disc may be made of a thin material that allows the container to remain substantially airtight.

Figure 1:
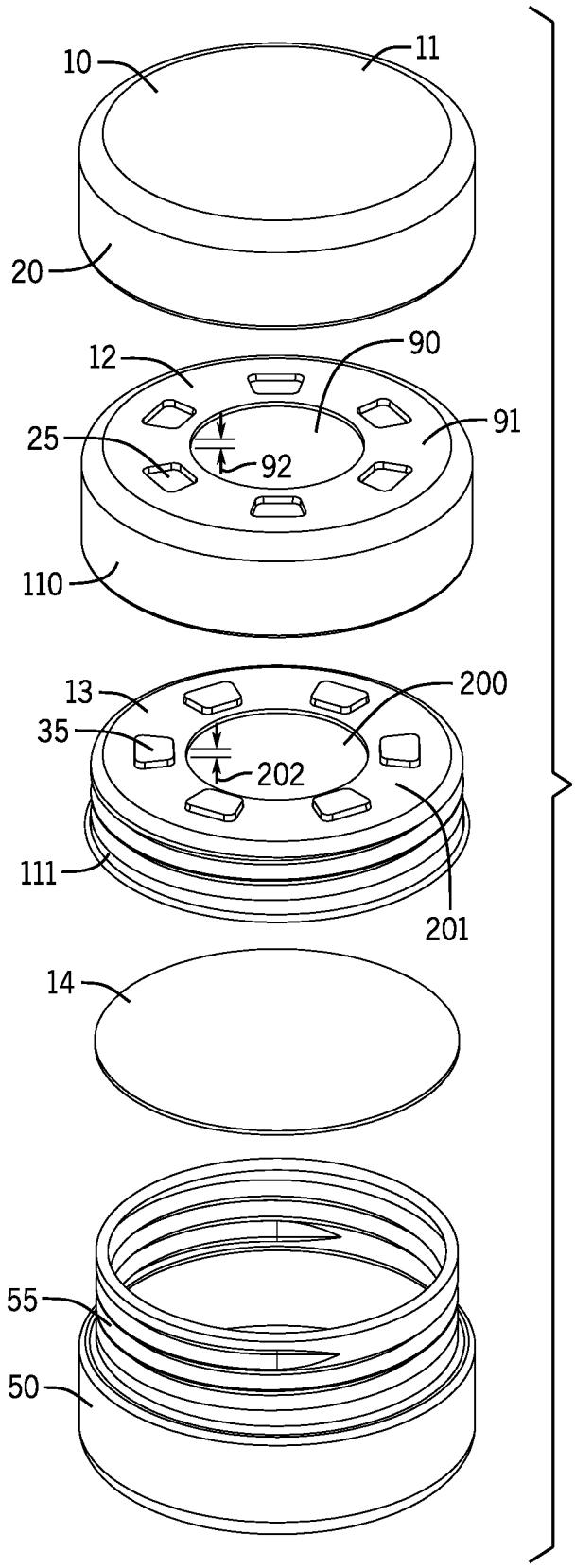
FIG. 1 illustrates an exploded view of the container.
Figure 2:
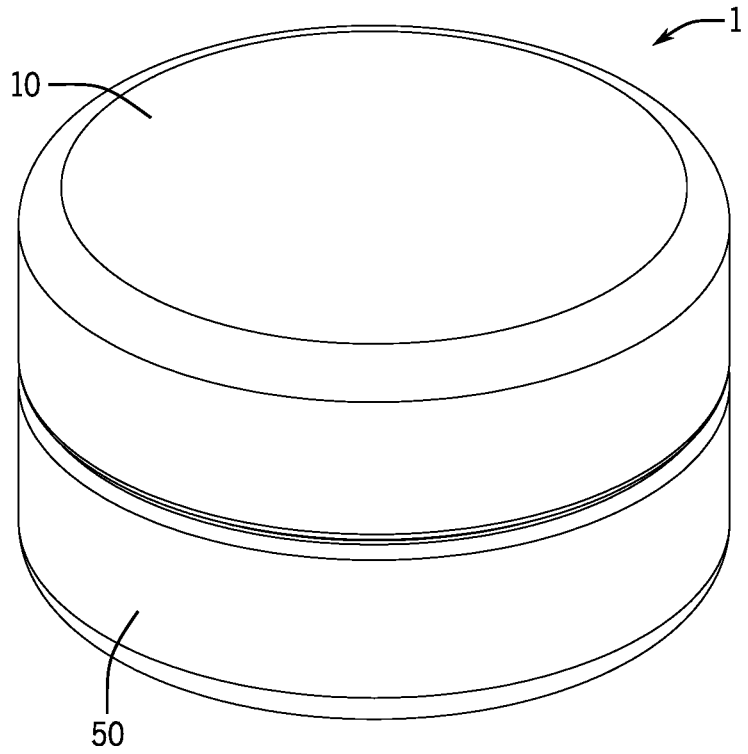
FIG. 2 illustrates the container in the sealed orientation wherein the top portion (the "lid") is secured to the bottom portion.
Figure 3:
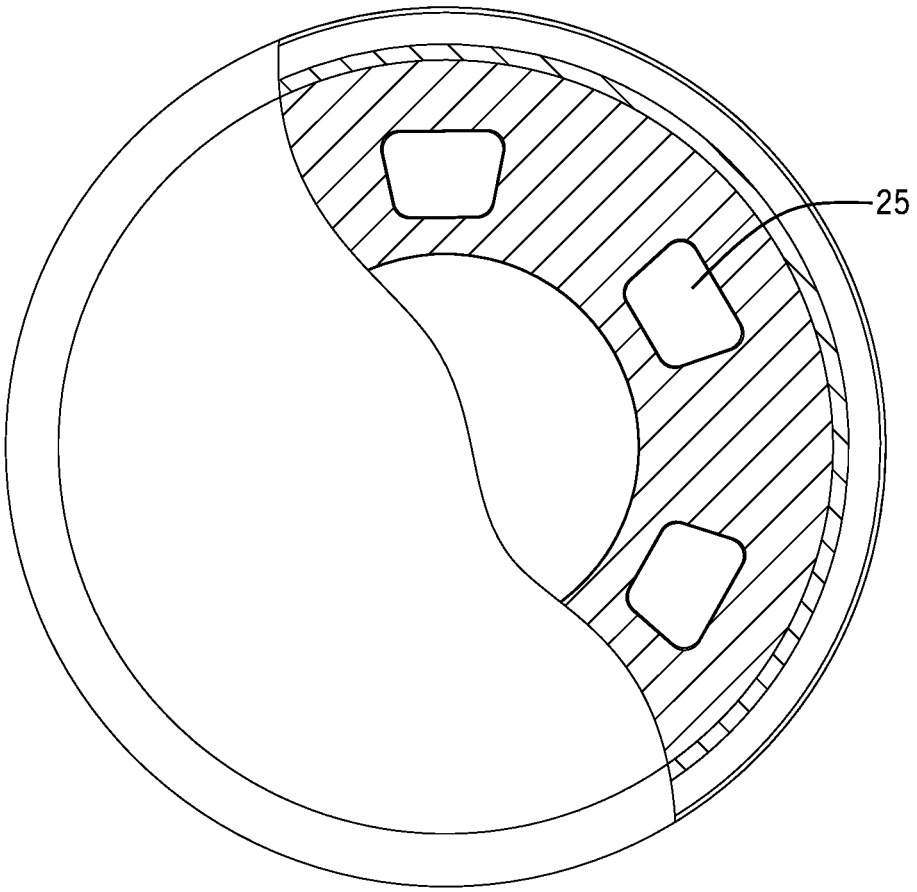
FIG. 3 illustrates a cut-away view of the top of the lid of the container.
Figure 4:
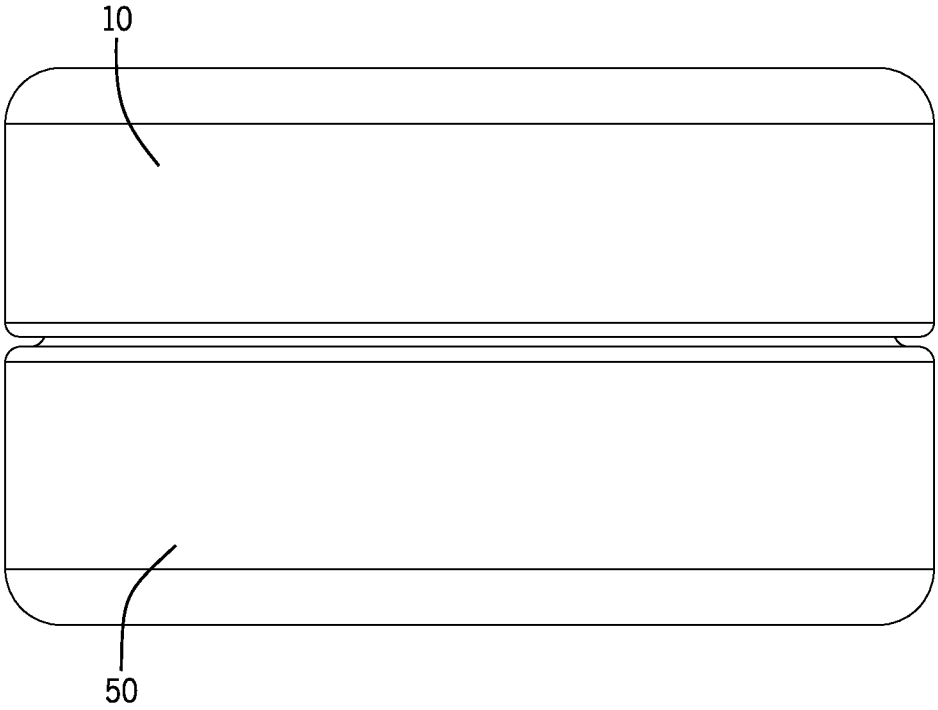
FIG. 4 is a side view of the sealed container.
Figure 5:
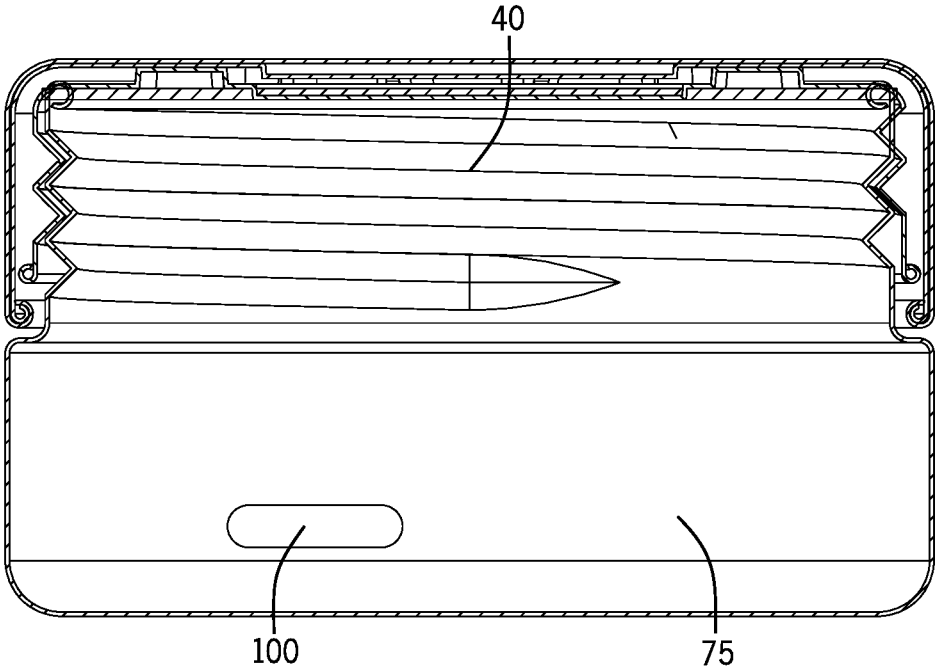
FIG. 5 is a cross-sectional view of the side of the container wherein the different layers are visible.
Figure 6:
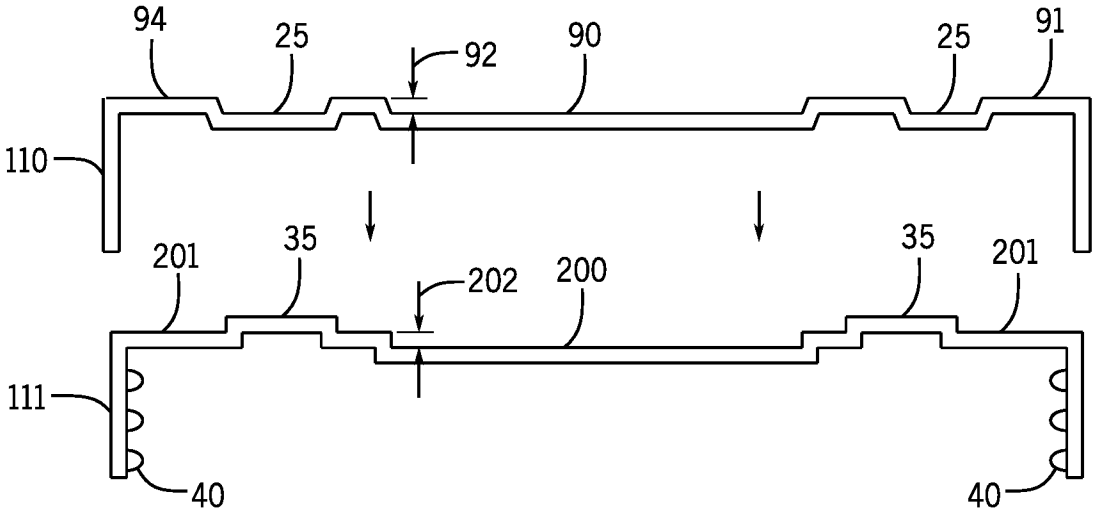
FIG. 6 is a cross-sectional view of the first and second disc of the present container in one embodiment.

Referring first to FIGS. 1 and 2, in an embodiment a secured container 1 is provided. The container 1 may have a lid (or "top") portion 10 and a bottom portion 50. The container 1 may be especially suitable for securing an item 100 (FIG. 5), such as medication, which can potentially be harmful to individuals, such as children, whom might otherwise gain access to the item from a non-secure container. In an embodiment, the container 1 is largely made of a durable material, such as plastic and/or metal. In one embodiment, the container 1 is largely made of tin.

In an embodiment, the lid portion 10 may be made of multiple elements. In particular, the lid portion 10 may have an exterior cover 11, a first disc 12, a second disc 13 and a generally flat protective layer 14. The exterior cover 11 may be the portion of the lid 10 that is most visible to the user. The exterior cover 11 may have the largest diameter of the multiple elements of the lid portion 10. A side 20 of the exterior cover 11 may extend downward and may cover the first disc 12, the second disc 13 and the generally flat protective layer 14. The first disc 12, the second disc 13 and the flat protective layer 14 may be permanently secured under the exterior cover 11.

In an embodiment, the first disc 12 may be permanently located between the exterior cover 11 and the second disc 13 while the second disc 13 is permanently located between the first disc 12 and the generally flat protective layer 14. The generally flat protective layer 14 may be made of, for example, foam, paper or plastic and may flexible so as to allow the container 1 to be generally air tight when the lid 10 is secured to the bottom portion 50.

The top of the first disc 12 may have a plurality of downwardly indented partial trapezoids 25 while the second disc 13 may have a plurality of upwardly extending partial trapezoids 35 of roughly the same shape and size. In an embodiment, the second disc 13 may have a side having a plurality of inward facing threaded members 40 which correspondingly lock with threaded members 55 of the bottom portion 50. The first disc 12 may lack the threaded members.

When the plurality of downwardly indented partial trapezoids 25 of the first disc 12 are aligned within the spaces in between the plurality of upwardly extending partial trapezoids 35 of the second disc 13 a user may therein push downward on the top of the lid 10 and may rotate the exterior cover 11 of the lid 10 to separate the lid 10 from the bottom portion 50 as a result of the sides of the trapezoids 25 of the first disc 12 contacting and pushing the sides of the trapezoids 35 of the second disc 13. In particular, as the sides of the trapezoids 25 of the first disc 12 push the sides of the trapezoids 35 of the second disc 13, the second disc 13 may therein be rotated.

When the plurality of downwardly indented partial trapezoids 25 of the first disc 12 are not aligned within the spaces of plurality of partial trapezoids 35 of the second disc 13, then rotating the exterior cover 11 of the lid 10 will not rotate the second disc 13 and the lid 10 cannot be separated from the bottom portion 50 of the container 1. As a result, the lid 10 is locked to the bottom portion 50. When the trapezoids 25, 35 are properly aligned as stated above, a user may press down on the top of the lid 10 (at the center of the top of the lid 10) and may rotate the lid 10 with respect to the bottom portion 50, therein moving the threaded members 40 and therein opening up the container 1 and exposing the interior 75 of the container 1 and contents 100 located inside.

In an embodiment, the first disc 12 may have a centralized downwardly intended circle 90. The centralized downwardly indented circle 90 may be lower than the peripheral perimeter edge 91 of the first disc 12. More specifically, a height 92 may separate the centralized downwardly intended circle 90 from the top surface of the peripheral perimeter edge 91 of the first disc 12 so that, when a user presses down on the exterior cover 11 of the lid 10 at the center of the exterior cover 11, the exterior cover 11 slightly is bent downward into the centralized downwardly indented circle 90 allowing the exterior cover 11 to slightly pull the perimeter side 110 first disc 12 away from the side 111 of the second disc 13 to further unlock the first disc 12 from the second disc 13 and allow the rotation of the first disc 12 independent of the second disc 13.

In an embodiment, the second disc 13 may also have a centralized downwardly intended circle 200. The centralized downwardly intended circle 200 of the second disc 13 may be generally the same size and shape as the centralized downwardly intended circle 90 of the first disc 12. As a result, when a user presses down on the top of the exterior cover 11 of the lid 10, the centralized intended circles 90, 200 may also slightly be depressed and may slightly bend the sides 110, 111 outward to unlock the lid.

In an embodiment the centralized downwardly indented circle 200 of the second disc 13 may be lower than the peripheral perimeter edge 201 of the second disc 13. A height 202 may separate the centralized downwardly intended circle 200 from the top surface of the peripheral perimeter edge 201 of the second disc 13 so that the first disc 12 and the second disc 13 may easily align to lock or unlock the container. Even further, having the centralized indented circles 90, 200 creates additional structural support to the container and makes the container more durable as opposed to having a flat top central portion of the discs 12, 13.

The exterior cover 11 may rotate three hundred and sixty degrees with respect to both the first disc 12 and the second disc 13 when a user is not pressing down on the top of the exterior cover 11. In particular, when a user is not pressing down on the top of the exterior cover 11 to bend the exterior cover 11 downward, the partial trapezoids 25 of the first disc 12 are either not aligned with, or lack the power to rotate, the trapezoids 35 of the second disc 13 to therein rotate the second disc 13 and unlock the container 1. Therefore, when a user manually twists the exterior cover 11 without pressing on center of the exterior cover 11, the exterior cover 11 merely rotates independent from the discs 12, 13. When the lid portion 10 is not properly aligned, the partial trapezoids 25 of the first disc 12 do not align into the spaces of the partial trapezoids 35 of the second disc 13 and a user cannot separate the lid 10 from the bottom portion 50.

In an embodiment, the lid 10 may have a curled, inward-rolled edge 60 so that the container 1 is smooth and forms an air-tight seal with the container is sealed. This may increase safety, reduce air and contaminants from contacting the contents 100 of the container 1 and may also increase the appearance of the container 1. Finally, in one embodiment, the lid 10 and the bottom portion 50 may both be slightly magnetically attracted to each other so as to form a greater seal.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A container comprising:

a lid portion having an exterior cover, a first disc, a second disc and a flat protective layer;

a bottom portion wherein the bottom portion is temporarily secured to the lid portion;

wherein the first disc has a top surface and wherein a plurality of partially downwardly indented trapezoids are located on the top surface of the first disc;

wherein the second disc has a top surface and wherein a plurality of partially upwardly extended trapezoids are located on the top surface of the second disc an indented circle on the top surface of the first disc;

an indented circle on the top surface of the second disc; and wherein the trapezoids of the first disc contact the trapezoids of the second disc to rotate the second disc to therein separate the lid portion from the bottom portion of the container.

2. The container of claim 1 wherein the bottom portion and the lid portion are magnetic.

3. The container of claim 1 further comprising:

an indented circle on the top surface of the first disc;

an indented circle on the top surface of the second disc; and wherein the indented circle of the first disc and the indented circle of the second disc are identical.

4. The container of claim 1 wherein the flat protective layer is flexible.

5. The container of claim 1 wherein the flat protective layer is made of a foam.

6. The container of claim 1 wherein the flat protective layer creates an air-tight seal between the lid portion and the bottom portion.

7. The container of claim 1 wherein a space is located between each of the partially upwardly extended trapezoids of the second disc and wherein the spaces between the partially upwardly extended trapezoids of the second disc each receive one of the plurality of trapezoids of the first disc and wherein a side of the trapezoids of the first disc contacts the trapezoids of the second disc and wherein the sides of the trapezoids of the first disc are capable of forcing the trapezoids of the second discs to move from a first position to a second position to separate the lid portion from the bottom portion of the container.

8. The container of claim 1 wherein the exterior cover, the first disc and the second disc are flexible.

* * * * *